US005738137A

United States Patent [19]

Reinke

[11] Patent Number: 5,738,137

[45] Date of Patent: Apr. 14, 1998

[54] APPARATUS FOR CREATING SURGES IN AN AQUARIUM

[76] Inventor: Mark A. Reinke, P.O. Box 37531, Denver, Colo. 80237

[21] Appl. No.: 757,577

[22] Filed: Nov. 27, 1996

Related U.S. Application Data

[60] Provisional application No. 60/007,864 Dec. 1, 1995.

[51] Int. Cl.[6] ..... F04F 10/00

[52] U.S. Cl. ..... 137/132; 119/250; 137/140

[58] Field of Search ..... 119/225, 248, 119/249, 250, 255; 137/132, 140

[56] References Cited

U.S. PATENT DOCUMENTS 2,976,879 3/1961 De Lisle et al. ..... 137/132
5,571,409 11/1996 Scarborough ..... 119/255 X

*Primary Examiner*—Gerald A. Michalsky
*Attorney, Agent, or Firm*—Dorr, Carson, Sloan & Birney, P.C.

[57] ABSTRACT

An apparatus for creating surges in an aquarium uses a pump to move water from the aquarium into an external tank. A siphon tube periodically creates surges by draining water from the tank back into the aquarium. The siphon tube has an inlet at a predetermined elevation within the tank, an outlet for discharging water from the tank into a smaller secondary basin, and an intermediate high point at an elevation above the inlet. The secondary basin has a series of water dispersion outlets that allow the surge to discharge into the aquarium. The siphon tube allows water to surge from the tank into the secondary basin and thence back into the aquarium when the water level in the tank rises above the high point of the siphon. The surge continues until the water level falls below the inlet to the siphon. The pump continues to pump water from the aquarium into the tank at a relatively constant rate throughout this entire process, but at a lower flow rate than can be drained by the siphon tube. After the surge stops, the water level in the tank gradually rises as water is pumped from the aquarium into the tank. The water level eventually reaches the high point of the siphon and starts the next surge. This process is continually repeated on periodic basis as long as the pump continues to pump water into the tank. The frequency, duration and intensity of the surges is determined by the relative flow rates of the pump and siphon tube, the size of the tank, and difference in elevations between the high point and inlet of the siphon tube. Adjustable deflectors can be attached to the outlets of the secondary basin to control the direction of the surges within the aquarium.

8 Claims, 5 Drawing Sheets

25
43
44
40
42
45
47
20
48
50
46
10
30

43
44
40
25
42
45
20
47
46
48
10
30

APPARATUS FOR CREATING SURGES IN AN AQUARIUM

BACKGROUND OF THE INVENTION

1. Related Application

This application is based on applicant's provisional U.S. patent application Ser. No. 60/007,864 filed on Dec. 1, 1995, entitled "Apparatus for Creating Surges in an Aquarium."

2. Field of the Invention

The present invention relates generally to the field of aquariums. More specifically, the present invention discloses an apparatus for creating periodic surges in an aquarium.

3. Statement of the Problem

Many forms of aquatic life that are sometimes kept in aquariums respond favorably to periodic surges within the aquarium. This is particularly true for organisms that are indigenous to coastal areas, including tidal pools, reefs, and shallow areas of the ocean adjacent to the surf.

The prior art has created surges in aquariums by means of a variety of relatively complicated mechanical devices. For example, one approach has been to periodically start and stop a pump to create a series of surges. This requires extensive control circuitry and also shortens the life of the pump. Another approach uses a continuously operating pump to lift water into a storage tank. A valve or gate at the bottom of the storage tank is periodically activated to empty the tank and thereby create a surge. Another approach uses a small electric motor and a mechanical linkage to create oscillatory motion in a panel immersed in the water to create surges. However, all of these prior art approaches have shortcomings in terms of complexity, reliability, or space requirements. In addition, it is difficult to use the prior art devices to accurately model the dynamic patterns of surges in coastal regions.

4. Solution to the Problem

The present invention overcomes the shortcomings associated with the prior art by using a continuously-operating pump, storage tank, and siphon tube that empties into a secondary basin with water dispersion outlets to automatically create periodic surges in an aquarium. This configuration offers the advantages of simplicity and reliability. In addition, the frequency, intensity, and duration of the surges can be easily adjusted to mimic natural conditions. The surges can be dispersed wherever desired in the aquarium, even in submerged locations.

SUMMARY OF THE INVENTION

This invention provides an apparatus for creating surges in an aquarium. A pump moves water from the aquarium into an external tank. A siphon tube periodically creates surges by draining water from the tank back into the aquarium. In particular, the siphon tube has an inlet at a predetermined elevation within the tank, an outlet for discharging water from the tank into a smaller secondary basin, and an intermediate high point at an elevation above the inlet. The secondary basin has a series of water dispersion outlets that allow the surge to discharge into the aquarium. The siphon tube allows water to surge from the tank into the secondary basin and thence back into the aquarium when the water level in the tank rises above the high point of the siphon. The surge continues until the water level falls below the inlet to the siphon. The pump continues to pump water from the aquarium into the tank at a relatively constant rate throughout this entire process, but at a lower flow rate than can be drained by the siphon tube. After the surge stops, the water level in the tank gradually rises as water is pumped from the aquarium into the tank. The water level eventually reaches the high point of the siphon and starts the next surge. This process is continually repeated on periodic basis as long as the pump continues to pump water into the tank. The frequency, duration and intensity of the surges is determined by the relative flow rates of the pump and siphon tube, the size of the tank, and difference in elevations between the high point and inlet of the siphon tube. Adjustable deflectors can be attached to the outlets of the secondary basin to control the direction of the surges within the aquarium. The deflectors can even be submerged due to the presence of the secondary basin that allows air trapped in the siphon to escape. The size of the secondary basin can be selected to minimize or even eliminate air bubbles from being entrained with the surge as it flows into the aquarium.

A primary object of the present invention is to provide a device for creating surges in an aquarium that has a minimum number of moving parts and is therefore simple and reliable to operate.

Another object of the present invention is to provide a device for creating surges in an aquarium that are similar to surges that naturally occur in coastal regions and lakes.

Another object of the present invention is to provide a device for creating surges that can be directed to several different desired regions of the aquarium.

Yet another object of the present invention is to provide an apparatus for creating surges in an aquarium that is relatively quiet, compact, inexpensive to manufacture, minimizes or eliminates entrained air (particularly micro-bubbles), and does not create hazardous stresses on the aquarium itself.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
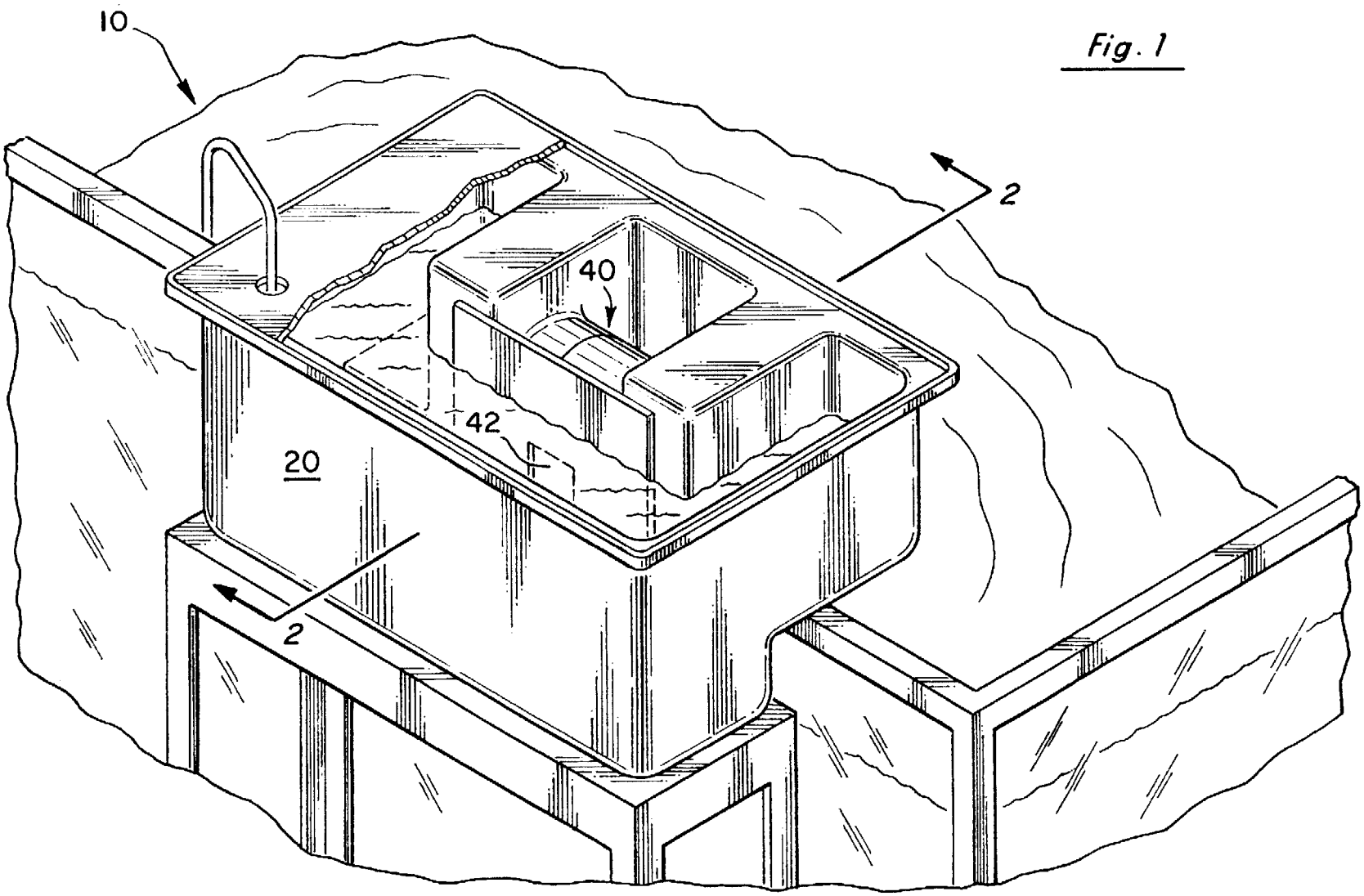
FIG. 1 is a rear perspective view of the entire assembly.
Figure 2:
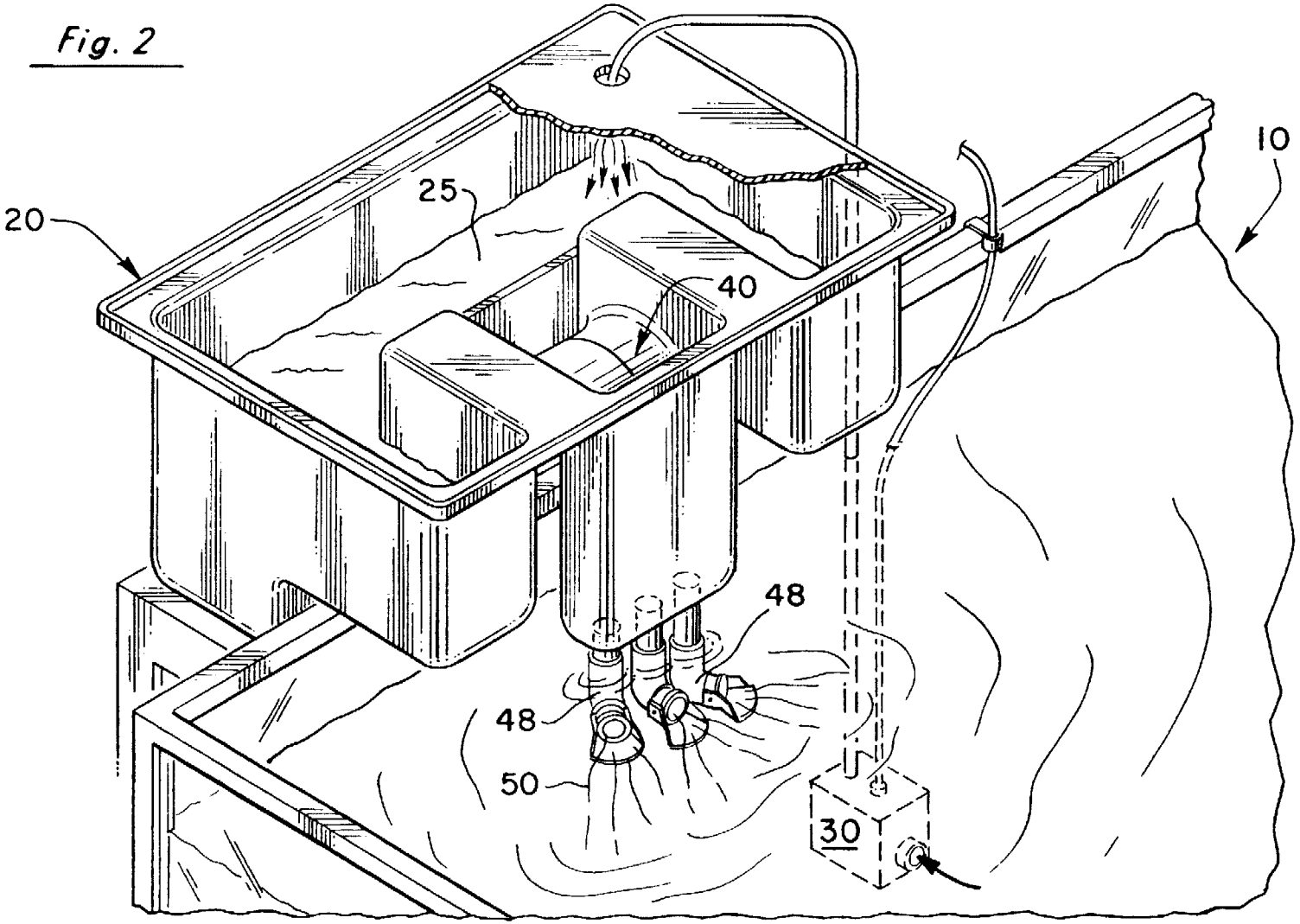
FIG. 2 is a front perspective view of the entire assembly corresponding to FIG. 1.

Turning to FIGS. 1 and 2, front and rear perspective views are provided of the entire assembly, including the aquarium 10, storage tank 20, and pump 30. The aquarium 10 can be any fresh-water or salt-water aquarium containing fish, plants, and other aquatic organisms. The tank 20 can be mounted to the side of the aquarium 10 as shown in the drawings so that the water level 25 in the tank 20 will be at least slightly above the water level in the aquarium 10. Alternatively, the tank 20 can be separately mounted from the aquarium 10, so long as water can flow by gravity from the device to the aquarium. The capacity of the tank 20 normally depends on the size of the aquarium 10, with the tank 20 normally being only a fraction of the size of the aquarium 10.

A pump 30 draws water from the aquarium 10 into the tank 20 at a generally constant flow rate and thereby causes the water level 25 in the tank 20 to progressively rise. Virtually any type of commercially-available pump can be used for this purpose. For example, the small inexpensive pumps that are commonly used to circulate water through aquarium filters are satisfactory.

A siphon tube 40 extends between the tank 20 and the aquarium 10. The siphon tube 40 has an inlet 42 located within the tank 20 and an outlet 46 within a secondary basin 47 located above the aquarium 10. The siphon tube 40 has the general shape of an inverted J, with the outlet 46 at an elevation below that of the inlet 42. The high point 44 of the siphon tube 40 is located between the inlet 42 and outlet 46, and at a predetermined elevation above the inlet 42. The cross-sectional area and difference in elevation between the inlet 42 and outlet 46 are selected to result in a natural flow rate through the siphon tube 40 that substantially exceeds the flow rate of the pump 30 into the tank 20. The size and placement of the siphon tubes 40 can be determined by experimentation or engineering design.

In the embodiment shown in the drawings, a siphon 40 is integrated into the structure of the tank 20 with a secondary basin 47 below the discharge of the siphon 40. The upward leg 43 of the siphon 40 is formed by constructing a hollow double wall extending upward from the inlet 42 along a portion of the tank 20. In this embodiment, the inlet 42 appears as an opening in the wall of the tank 20 at a fixed elevation above the bottom of the tank 20. The siphon passes through the tank wall at the high point 44 of the siphon. The downward leg 45 of the siphon 40 can also be constructed as a hollow double wall of the tank 20 below the high point 44 of the siphon. The downward leg 45 of the siphon 40 empties into a smaller secondary basin 47 having a series of outlets that allow water to flow back into the aquarium 10. Adjustable deflectors 48 attached to each outlet control the direction of the resulting surge in the aquarium 10 as depicted in FIG. 2. The secondary basin 46 above the adjustable deflectors 48 provides an air space between the siphon and aquarium. This permits the deflectors 48 to be located wherever desired, even in deeply submerged locations, without the need for an extremely large tank 20. It also allows air to escape from the surge entering the aquarium 10. The deflectors 48 also permit the surges to be simultaneously directed to several different regions of the aquarium.

Figure 3:
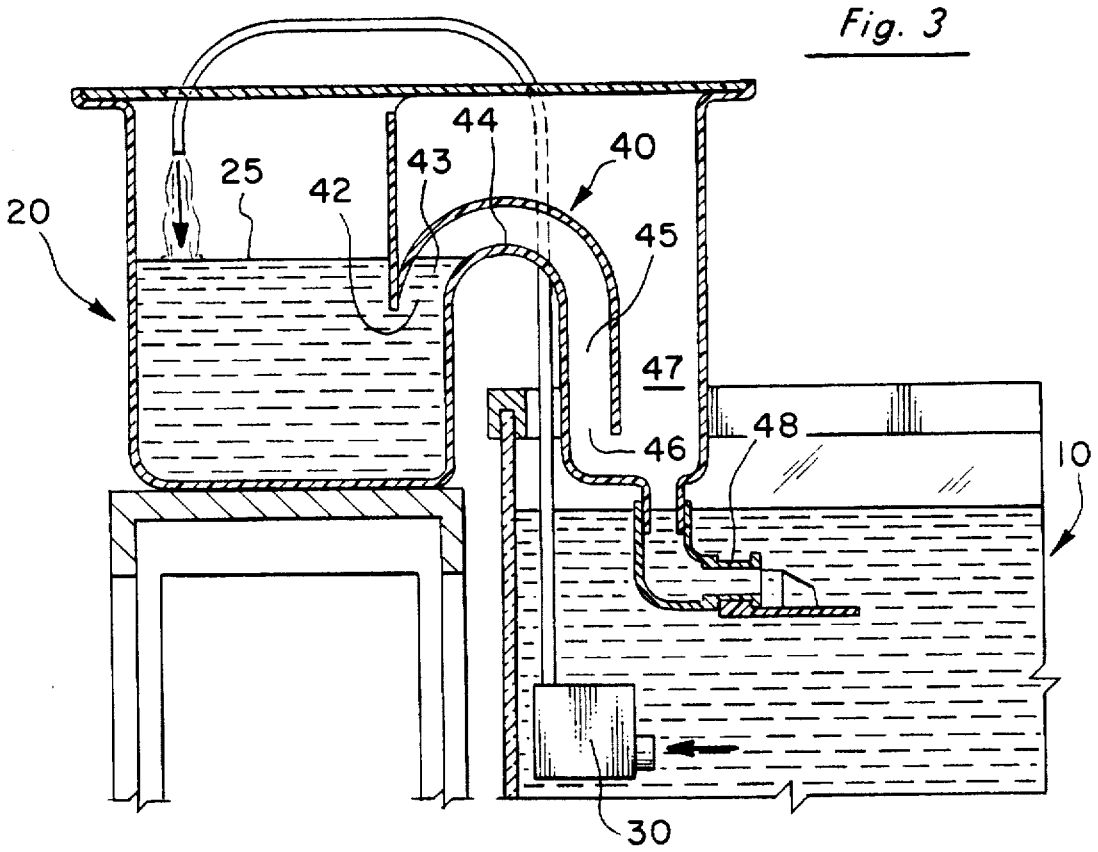
FIG. 3 is a side cross-sectional view of the tank 20, siphon tube 40, and a portion of the aquarium 10 with the water level 25 in the tank 20 approaching the high point 44 of the siphon 40.
Figure 4:
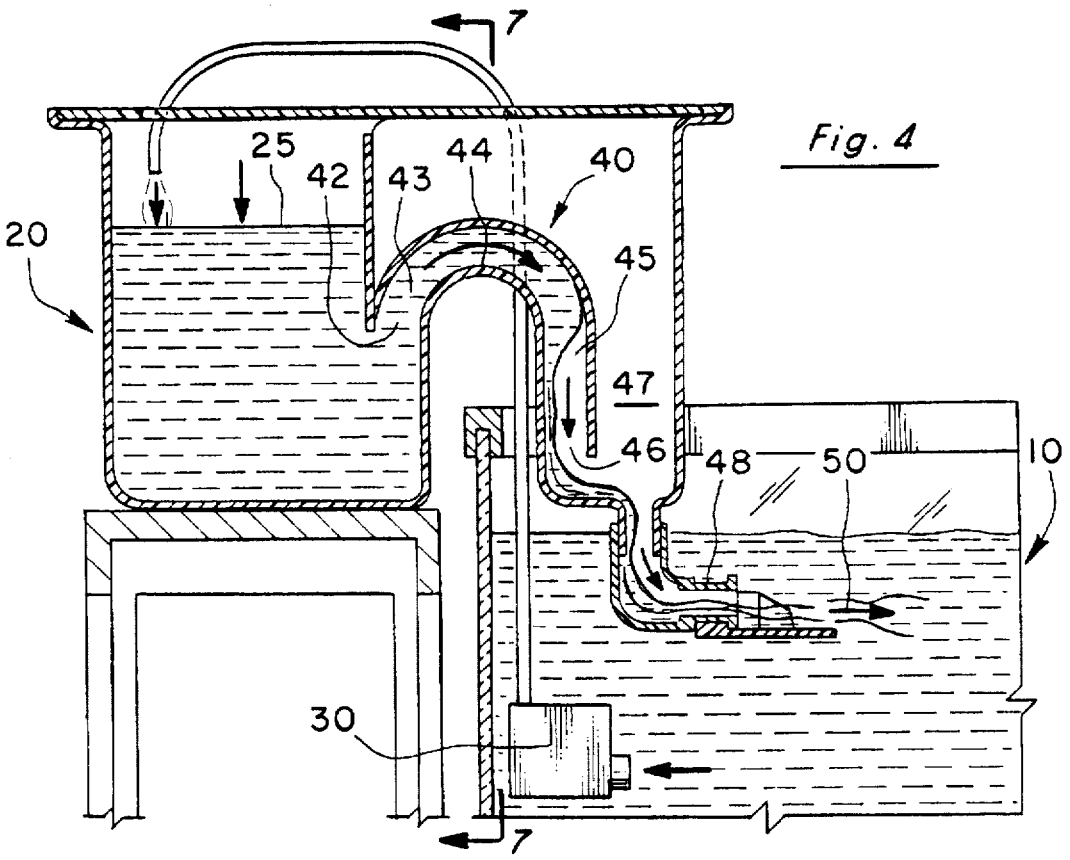
FIG. 4 is a side cross-sectional view corresponding to FIG. 3 after the surge 50 has begun to flow through the siphon 40 into the secondary basin 47 and then into aquarium 10, with the water level 25 in the tank 20 dropping.
Figure 5:
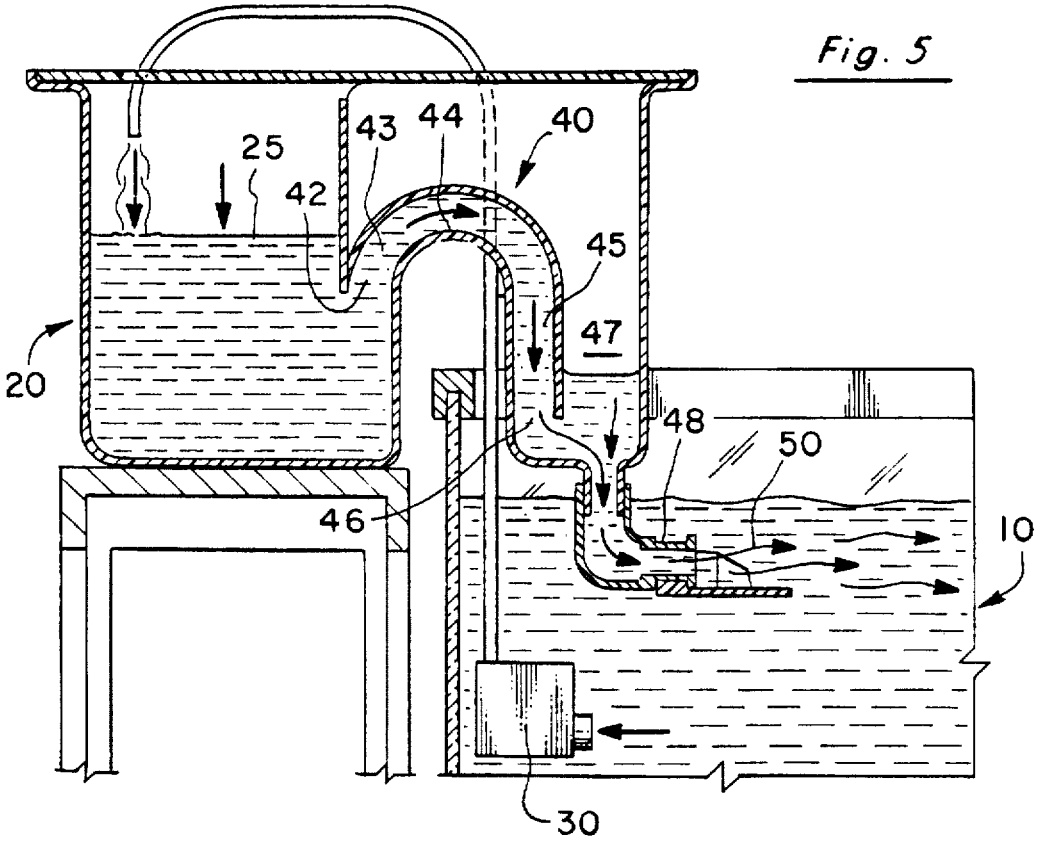
FIG. 5 is a side cross-sectional view corresponding to FIGS. 3 and 4 after the surge 50 through the siphon 40 has partially filled the smaller secondary basin 47
Figure 6:
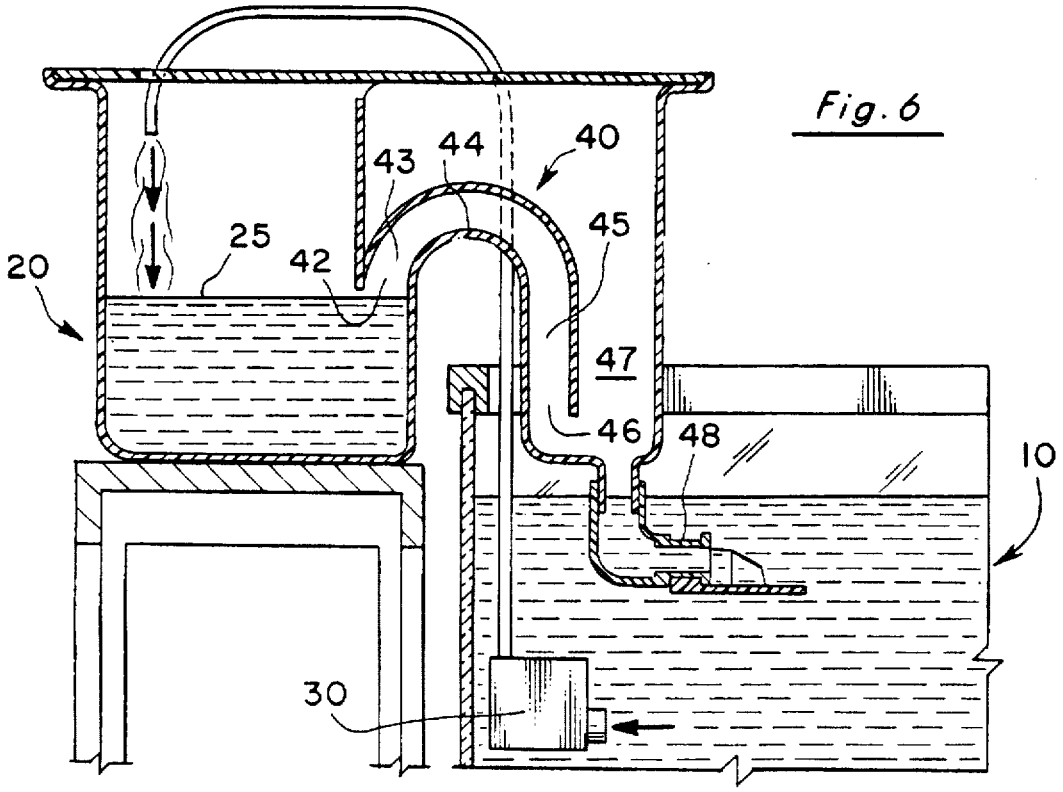
FIG. 6 is a side cross-sectional view corresponding to FIGS. 3, 4, and 5 after the surge 50 has stopped flowing through siphon 40 and the water level 25 in the tank 20 is below the inlet 42 of the siphon.

In operation, the pump 30 draws water from the aquarium 10 into the tank 20 at a steady rate and gradually raises the water level 25 in the tank 20 above the inlet 42 to the siphon 40 as shown in FIG. 3. This continues until the water level 25 exceeds the high point 44 of the siphon. At this point, the siphon 40 automatically begins to flow. The initial flow through the siphon may be relatively small (e.g., a trickle or intermittent flow) until the water level 25 in the tank 20 is sufficiently high to completely fill the siphon, as depicted in FIG. 4. At this point, water surges through the siphon 40 and starts to drain the tank 20, as shown in FIGS. 4 and 5, because the flow rate through the siphon 40 is much greater than the flow into the tank 20 from the pump 30. The surge 50 flows through the siphon 40 into the secondary basin 47 and back into the aquarium 10. Each surge 50 continues until the water level 25 in the tank 20 falls below the inlet 42 to the siphon 40 as illustrated in FIG. 6. The siphon 40 then stops until the pump 30 raises the water level 25 above the high point 44 of the siphon 40 to repeat the process.

The frequency, duration, and intensity of the surges 50 are determined by the relative flow rates of the pump 30 and siphon 40, the size of the tank 20, and the difference in elevations between the high point 44 and inlet 42 of the siphon 40. If necessary, the relative flow rates of the siphon 40 and pump 30 can be adjusted by either using a variable speed pump or by intermittently operating the pump. Another alternative would be to use a valve to regulate the flow supplied by the pump 30 into the tank 20. A valve mechanism could also be installed within the siphon 40 to adjust its flow rate.

Figure 7:
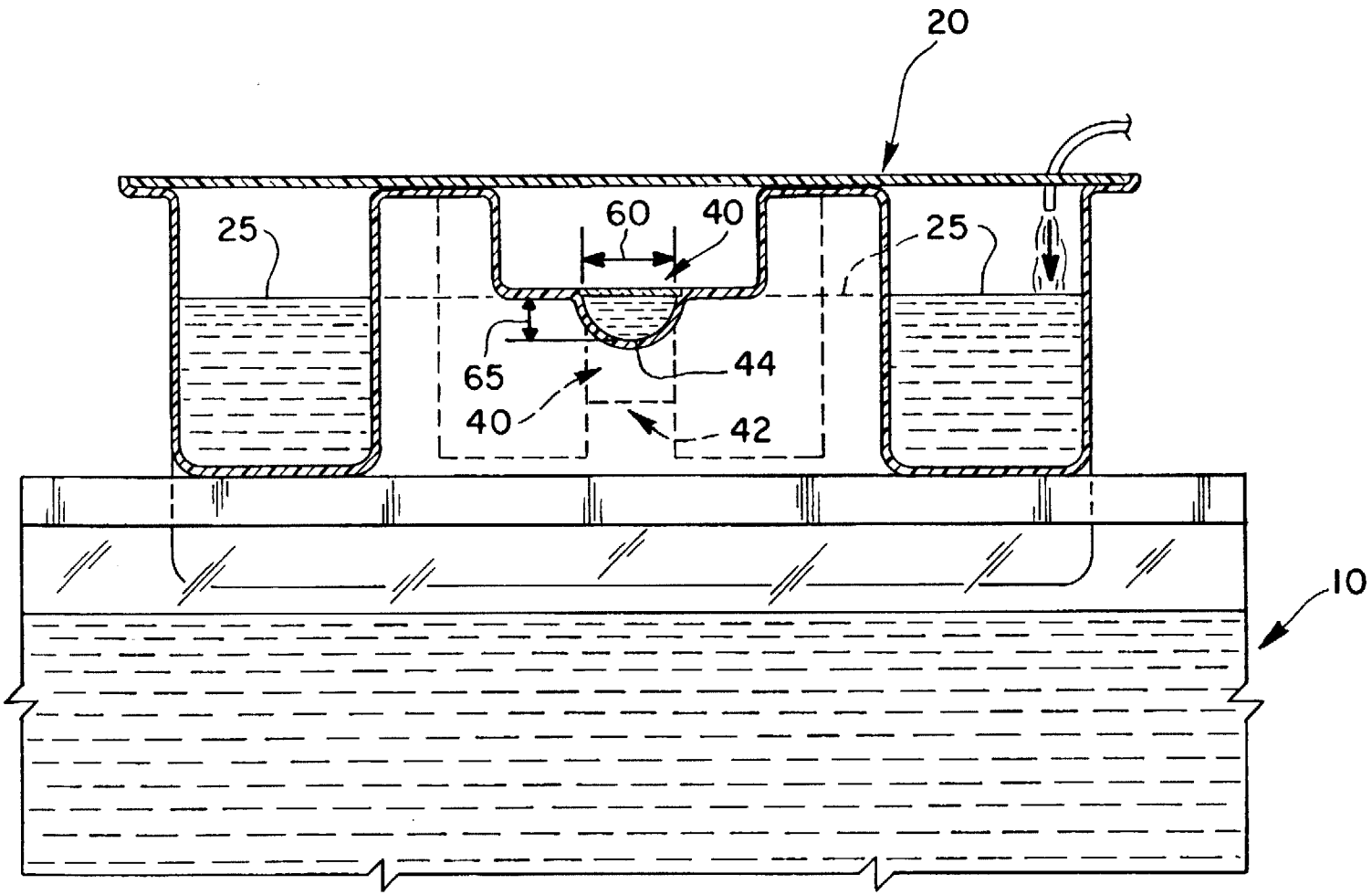
FIG. 7 is a side cross-sectional view of the tank 20, showing the horizontal dimension 60 and vertical dimension 65 at the high point 44 of the siphon 40.

Experience has shown that it is important to create surges that closely imitate natural surf in a tidal pool, reef, or lake for the well-being of the fish and other organisms in the aquarium 10. Natural surges tend to start with a swell, build to a full force, and then abruptly stop. The elongated rectangular cross-section of the siphon tube 40 shown in the FIG. 7 has been found to create a siphoning action that closely imitates natural swell and surge action. In particular, the siphon 40 has a relatively large cross-sectional area that allows in a high flow rate during each surge. The horizontal dimension 60 of the siphon 40 at its high point 44 is much greater than its vertical dimension 65. This causes the siphon 40 to rapidly draw water from the tank after the water level 25 exceeds the high point 44 of the siphon and thereby create an abrupt surge within the aquarium 10. The surge continues at a relatively constant flow until the water level 25 in the tank drops below the inlet 42 to the siphon 40. As the tank drains, air first contacts the wide horizontal dimension of the siphon inlet, which also causes the siphon flow to stop more abruptly and reliably. At that point, the surge suddenly stops and the siphon 40 quickly drains itself into the aquarium 10. The water in the secondary basin also drains very quickly until the water level in the deflectors 48 equals that of the aquarium. This shape of siphon also requires less precise control over the pump flow rate used to create the desired surge action.

The invention also includes a water pathway to deliver water to the aquarium 10 in the event the siphon 40 fails for any reason. Should the siphon 40 become clogged, be overwhelmed by the flow from the pump, or otherwise fail, water will flow over the wall that extends vertically from the siphon inlet 42 and into the secondary basin 47. It then flows safely back into the aquarium 10.

The surge interval and volume can also be manipulated by changing the tank volume. This can be accomplished by displacing a portion of the tank capacity with an object, or by installing an adjustable partition in the tank. The smaller the holding capacity of the tank, the smaller the volume of the resulting surges, and the more frequent the surges become. Conversely, the larger the holding capacity of the tank, the larger the volume of the resulting surges, and the longer the interval between surges becomes.

The above disclosure sets forth a number of embodiments of the present invention. Other arrangements or embodiments, not precisely set forth, could be practiced under the teachings of the present invention and as set forth in the following claims.

I claim:

1. An apparatus for creating surges in an aquarium comprising:

a tank;

a secondary basin having an outlet for discharging water from said secondary basin into said aquarium;

a pump for pumping water from said aquarium into said tank; and a siphon tube having:

(a) an inlet at a predetermined elevation in said tank;

(b) an outlet for discharging water from said tank into said secondary basin, said outlet having an elevation below said inlet; and (c) a high point between said inlet and said outlet with an elevation above said inlet; and said siphon tube allowing water to surge from said tank through said secondary basin and into said aquarium when the level of water pumped into said tank rises above said high point, and continuing until said water level falls below said inlet.

2. The apparatus of claim 1 wherein said secondary basin is open to the atmosphere thereby allowing air entrained by said siphon to escape from the surge entering the aquarium.

3. The apparatus of claim 1 wherein said secondary basin has a plurality of adjustable outlet deflectors for directing the surge of water into said aquarium.

4. The apparatus of claim 1 wherein the horizontal dimension of said siphon is greater than the vertical dimension at said high point between said inlet and said outlet.

5. The apparatus of claim 1 wherein said tank and said secondary basin are separated by a partition, said partition terminating at an elevation below the top of said tank, thereby allowing water to flow from said tank into said secondary basin for return to said aquarium in the event said siphon should fail.

6. An apparatus for creating surges in an aquarium comprising:

a tank;

a secondary basin having an outlet for discharging water from said secondary basin into said aquarium, said outlet having a plurality of deflectors for directing the flow of water into said aquarium;

a pump for pumping water from said aquarium into said tank; and a siphon tube having:

(a) an inlet at a predetermined elevation in said tank;

(b) an outlet for discharging water from said tank into said secondary basin, said outlet having an elevation below said inlet; and (c) a high point between said inlet and said outlet between said tank and said secondary basin;

said siphon tube allowing water to surge from said tank into said secondary basin, and from said secondary basin into said aquarium when the level of water pumped into said tank rises above said high point, and continuing until said water level falls below said inlet; and a partition separating said tank and said secondary basin, said partition terminating at an elevation below the top of said tank, thereby allowing water to flow from said tank into said secondary basin for return to said aquarium in the event said siphon should fail.

7. The apparatus of claim 6 wherein said secondary basin is open to the atmosphere thereby allowing air entrained by said siphon to escape from the surge entering the aquarium.

8. The apparatus of claim 6 wherein the horizontal dimension of said siphon is greater than the vertical dimension at said high point between said inlet and said outlet.

* * * * *